US008028764B2

(12) United States Patent
Teodorescu

(10) Patent No.: US 8,028,764 B2
(45) Date of Patent: Oct. 4, 2011

(54) METHODS AND APPARATUSES FOR ESTIMATING DRILL BIT CONDITION

(75) Inventor: Sorin Gabriel Teodorescu, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 272 days.

(21) Appl. No.: 12/391,665

(22) Filed: Feb. 24, 2009

(65) Prior Publication Data

US 2010/0212961 A1 Aug. 26, 2010

(51) Int. Cl.
*E21B 7/00* (2006.01)
*E21B 44/00* (2006.01)
*E21B 47/00* (2006.01)

(52) U.S. Cl. ..... 175/57; 175/40; 73/152.48; 73/152.46

(58) Field of Classification Search ..... 175/57, 175/40; 73/152.48, 152.46
See application file for complete search history.

(56) References Cited

U.S. PATENT DOCUMENTS 4,715,451 A * 12/1987 Bseisu et al. ..... 175/40
4,763,736 A 8/1988 Varel, Sr.
4,884,071 A 11/1989 Howard
4,958,125 A * 9/1990 Jardine et al. ..... 324/162
4,965,774 A * 10/1990 Ng et al. ..... 367/75
5,178,222 A 1/1993 Jones et al.
5,501,285 A 3/1996 Lamine et al.
5,720,355 A * 2/1998 Lamine et al. ..... 175/27
6,349,595 B1 2/2002 Civolani et al.
6,435,288 B1 8/2002 Dobran et al.
6,459,992 B1 * 10/2002 Freedman et al. ..... 702/6
6,518,756 B1 * 2/2003 Morys et al. ..... 324/303
6,817,425 B2 11/2004 Schultz et al.
6,845,340 B2 * 1/2005 Edie et al. ..... 702/179
6,873,918 B2 * 3/2005 Curless et al. ..... 702/36
6,975,112 B2 * 12/2005 Morys et al. ..... 324/303
7,017,662 B2 3/2006 Schultz et al.
7,035,778 B2 * 4/2006 Goldman et al. ..... 703/10
7,147,066 B2 * 12/2006 Chen et al. ..... 175/61
7,168,506 B2 1/2007 Boucher et al.
7,243,735 B2 7/2007 Koederitz et al.
7,299,884 B2 * 11/2007 Mathiszik ..... 175/48
7,313,480 B2 * 12/2007 Chen et al. ..... 702/9
7,316,277 B2 * 1/2008 Jeffryes ..... 175/27

(Continued)

OTHER PUBLICATIONS

Written Opinion of the International Searching Authority for International Application No. PCT/US2010/024968 dated Jun. 16, 2010, 3 pages.

(Continued)

*Primary Examiner* — Jennifer H Gay
(74) *Attorney, Agent, or Firm* — TraskBritt

(57) ABSTRACT

A drill bit for drilling subterranean formations includes a bit body bearing at least one gage pad and a shank extending from the bit body. An annular chamber is formed within the shank. A data evaluation module is disposed in the annular chamber and includes a processor, a memory, and a communication port. The data evaluation module estimates a gage pad wear by periodically sampling a tangential accelerometer and a radial accelerometer disposed in the drill bit. A history of the tangential acceleration and the radial acceleration is analyzed to determine a revolution rate, gage-slipping periods, and gage-cutting periods. A change in a gage-pad-wear state is estimated responsive to an analysis of the revolution rate, the at least one gage-cutting period and the at least one gage-slipping period. The determination of the gage-pad-wear state may also include analyzing a formation hardness.

26 Claims, 12 Drawing Sheets

U.S. PATENT DOCUMENTS

| | | | | |
|---|---|---|---|---|
| 7,426,967 | B2 * | 9/2008 | Sugiura | 175/38 |
| 7,426,969 | B2 * | 9/2008 | Azar | 175/426 |
| 7,676,326 | B2 * | 3/2010 | Podladchikov et al. | 702/11 |
| 2004/0245017 | A1 * | 12/2004 | Chen et al. | 175/41 |
| 2004/0251898 | A1 * | 12/2004 | Morys et al. | 324/303 |
| 2005/0016769 | A1 * | 1/2005 | Wallace | 175/40 |
| 2005/0279532 | A1 | 12/2005 | Ballantyne et al. | |
| 2006/0099885 | A1 * | 5/2006 | Lynde et al. | 451/5 |
| 2006/0162968 | A1 * | 7/2006 | Durairajan et al. | 175/431 |
| 2006/0272859 | A1 | 12/2006 | Pastusek et al. | |
| 2007/0107937 | A1 * | 5/2007 | Sugiura | 175/45 |
| 2007/0205023 | A1 | 9/2007 | Hoffmaster et al. | |
| 2007/0240904 | A1 | 10/2007 | Stauffer et al. | |
| 2007/0272442 | A1 * | 11/2007 | Pastusek et al. | 175/40 |
| 2008/0023225 | A1 * | 1/2008 | Lynde et al. | 175/39 |
| 2008/0149398 | A1 * | 6/2008 | Azar | 175/406 |
| 2008/0179108 | A1 | 7/2008 | McClain et al. | |
| 2009/0078461 | A1 * | 3/2009 | Mansure et al. | 175/17 |
| 2009/0194332 | A1 * | 8/2009 | Pastusek et al. | 175/40 |
| 2009/0222209 | A1 * | 9/2009 | Morys | 702/9 |
| 2010/0097890 | A1 * | 4/2010 | Sullivan et al. | 367/82 |
| 2010/0108380 | A1 * | 5/2010 | Teodorescu | 175/24 |
| 2010/0212961 | A1 * | 8/2010 | Teodorescu | 175/39 |

OTHER PUBLICATIONS

International Search Report for International Application No. PCT/US2010/024968 dated Jun. 16, 2010, 3 pages.

* cited by examiner

METHODS AND APPARATUSES FOR ESTIMATING DRILL BIT CONDITION

TECHNICAL FIELD

Embodiments of the present invention relate generally to drill bits for drilling subterranean formations and, more particularly, to methods and apparatuses for monitoring operating parameters of drill bits during drilling operations.

BACKGROUND

The oil and gas industry expends sizable sums to design cutting tools, such as downhole drill bits including roller cone bits, also termed "rock" bits as well as fixed cutter bits, which have relatively long service lives, with relatively infrequent failure. In particular, considerable sums are expended to design and manufacture roller cone rock bits and fixed cutter bits in a manner that minimizes the opportunity for catastrophic drill bit failure during drilling operations. The loss of a roller cone or a polycrystalline diamond compact (PDC) from a fixed cutter bit during drilling operations can impede the drilling operations and, at worst, necessitate rather expensive fishing operations. If the fishing operations fail, sidetrack-drilling operations must be performed in order to drill around the portion of the wellbore that includes the lost roller cones or PDC cutters. Typically, during drilling operations, bits are pulled and replaced with new bits even though significant service could be obtained from the replaced bit. These premature replacements of downhole drill bits are expensive, since each trip out of the well prolongs the overall drilling activity by wasting valuable rig time and consumes considerable manpower, but are nevertheless done in order to avoid the far more disruptive and expensive process of, at best, pulling the drillstring and replacing the bit or fishing and sidetrack drilling operations necessary if one or more cones or compacts are lost due to bit failure.

With the ever-increasing need for downhole drilling system dynamic data, a number of "subs" (i.e., a sub-assembly incorporated into the drillstring above the drill bit and used to collect data relating to drilling parameters) have been designed and installed in drillstrings. Unfortunately, these subs cannot provide actual data for what is happening operationally at the bit due to their physical placement above the bit itself.

Data acquisition is conventionally accomplished by mounting a sub in the bottom hole assembly (BHA), which may be several feet to tens of feet away from the bit. Data gathered from a sub this far away from the bit may not accurately reflect what is happening directly at the bit while drilling occurs. Often, this lack of data leads to conjecture as to what may have caused a bit to fail or why a bit performed so well, with no directly relevant facts or data to correlate to the performance of the bit.

Recently, data acquisition systems have been proposed to install in the drill bit itself. However, data gathering, storing, and reporting from these systems have been limited. In addition, conventional data gathering in drill bits has not had the capability to adapt to drilling events that may be of interest in a manner enabling more detailed data gathering and analysis when these events occur.

There is a need for a drill bit equipped to gather, store, and analyze long-term data that is related to cutting performance and condition of the drill bit and gage pads of the drill bit.

BRIEF SUMMARY OF THE INVENTION

The present invention includes methods and apparatuses to develop information related to cutting performance and condition of the drill bit and gage pads of the drill bit. As non-limiting examples, the drill bit condition information may be used to determine when a drill bit is near its end of life and should be changed and when drilling operations should be changed to extend the life of the drill bit. The drill bit condition information from an existing drill bit may also be used for developing future improvements to drill bits.

In one embodiment of the invention, a drill bit for drilling a subterranean formation includes a bit body bearing at least one gage pad and a shank extending from the bit body and adapted for coupling to a drillstring. An annular chamber is formed within the shank. A set of accelerometers is disposed in the drill bit and includes a radial accelerometer for sensing radial acceleration of the drill bit and a tangential accelerometer for sensing tangential acceleration of the drill bit. A data evaluation module is operably coupled to the set of accelerometers and disposed in the annular chamber. The data evaluation module includes a processor, a memory, and a communication port. The data evaluation module is configured for sampling acceleration information from the radial accelerometer and the tangential accelerometer over an analysis period and storing the acceleration information in the memory to generate an acceleration history. The data evaluation module is further configured for analyzing the acceleration history to determine a distance traveled by the at least one gage pad, to determine at least one gage-cutting period and to determine at least one gage-slipping period. The data evaluation module is also configured for estimating gage pad wear responsive to the analysis of the distance traveled, the at least one gage-cutting period and the at least one gage-slipping period.

In another embodiment of the invention, a drill bit for drilling a subterranean formation includes a bit body bearing at least one gage pad and a shank extending from the bit body and adapted for coupling to a drillstring. An annular chamber is formed within the shank. At least one radial accelerometer for sensing radial acceleration of the drill bit and at least one tangential accelerometer for sensing tangential acceleration of the drill bit are disposed in the drill bit. A data evaluation module is operably coupled to the set of accelerometers and disposed in the annular chamber. The data evaluation module includes a processor, a memory, and a communication port and is configured for receiving formation hardness information through the communication port. The data evaluation module is also configured for sampling acceleration information from the at least one radial accelerometer and the at least one tangential accelerometer over an analysis period and analyzing the acceleration information to determine a revolution rate of the drill bit. The data evaluation module is also configured to estimate a gage pad wear responsive to an analysis of the revolution rate and the formation hardness information.

Another embodiment of the invention is a method that periodically collects sensor data by sampling over an analysis period at least one tangential accelerometer disposed in a drill bit and at least one radial accelerometer disposed in the drill bit. The method also includes processing the sensor data in the drill bit to develop a tangential acceleration history and a radial acceleration history. The tangential acceleration history and the radial acceleration history are analyzed to determine a revolution rate of the drill bit, at least one gage-slipping period, and at least one gage-cutting period. A change in a gage-pad-wear state is estimated responsive to an analysis of the revolution rate, the at least one gage-cutting period and the at least one gage-slipping period.

Another embodiment of the invention is a method that collects acceleration information by periodically sampling at least two accelerometers disposed in a drill bit over an analysis period to develop an acceleration history. The acceleration history is processed in the drill bit to determine a distance profile of at least one gage pad on the drill bit. The method also includes determining a current formation hardness. The distance profile of the at least one gage pad and the current formation hardness are analyzed to estimate and report a gage-pad-wear history.

DETAILED DESCRIPTION OF THE INVENTION

The present invention includes methods and apparatuses to develop information related to condition of the drill bit and gage pads of the drill bit. As non-limiting examples, the drill bit condition information may be used to determine when a drill bit is near its end of life and should be changed and when drilling operations should be changed to extend the life of the drill bit. The drill bit condition information from an existing drill bit may also be used for developing future improvements to drill bits.

Figure 1:
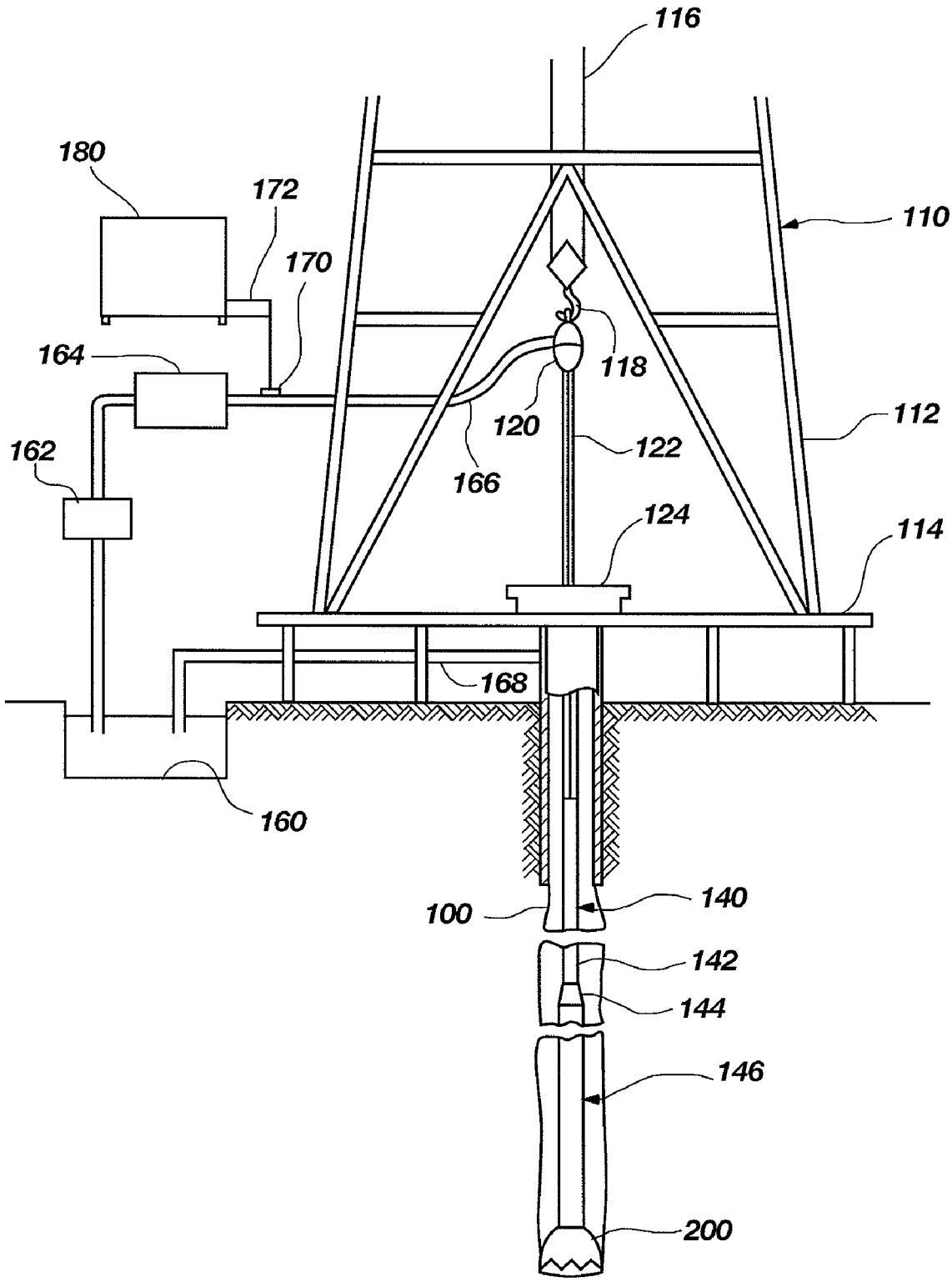
FIG. 1 illustrates a conventional drilling rig for performing drilling operations.

FIG. 1 depicts an example of conventional apparatus for performing subterranean drilling operations. Drilling rig 110 includes a derrick 112, a derrick floor 114, a draw works 116, a hook 118, a swivel 120, a Kelly joint 122, and a rotary table 124. A drillstring 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drillstring 140 may include a measurement-while-drilling (MWD) logging subassembly and cooperating mud pulse telemetry data transmission subassembly, which are collectively referred to as an MWD communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial central bore in the drillstring 140. Eventually, it exits through apertures or nozzles, which are located in a drill bit 200, which is connected to the lowermost portion of the drillstring 140 below drill collar section 144. The drilling mud flows back up through an annular space between the outer surface of the drillstring 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The MWD communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 146. Mud pulses that define the data propagated to the surface are produced by equipment conventionally located within the MWD communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown), which may be located near a bottom hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a back up for the turbine-driven generator.

Figure 2:
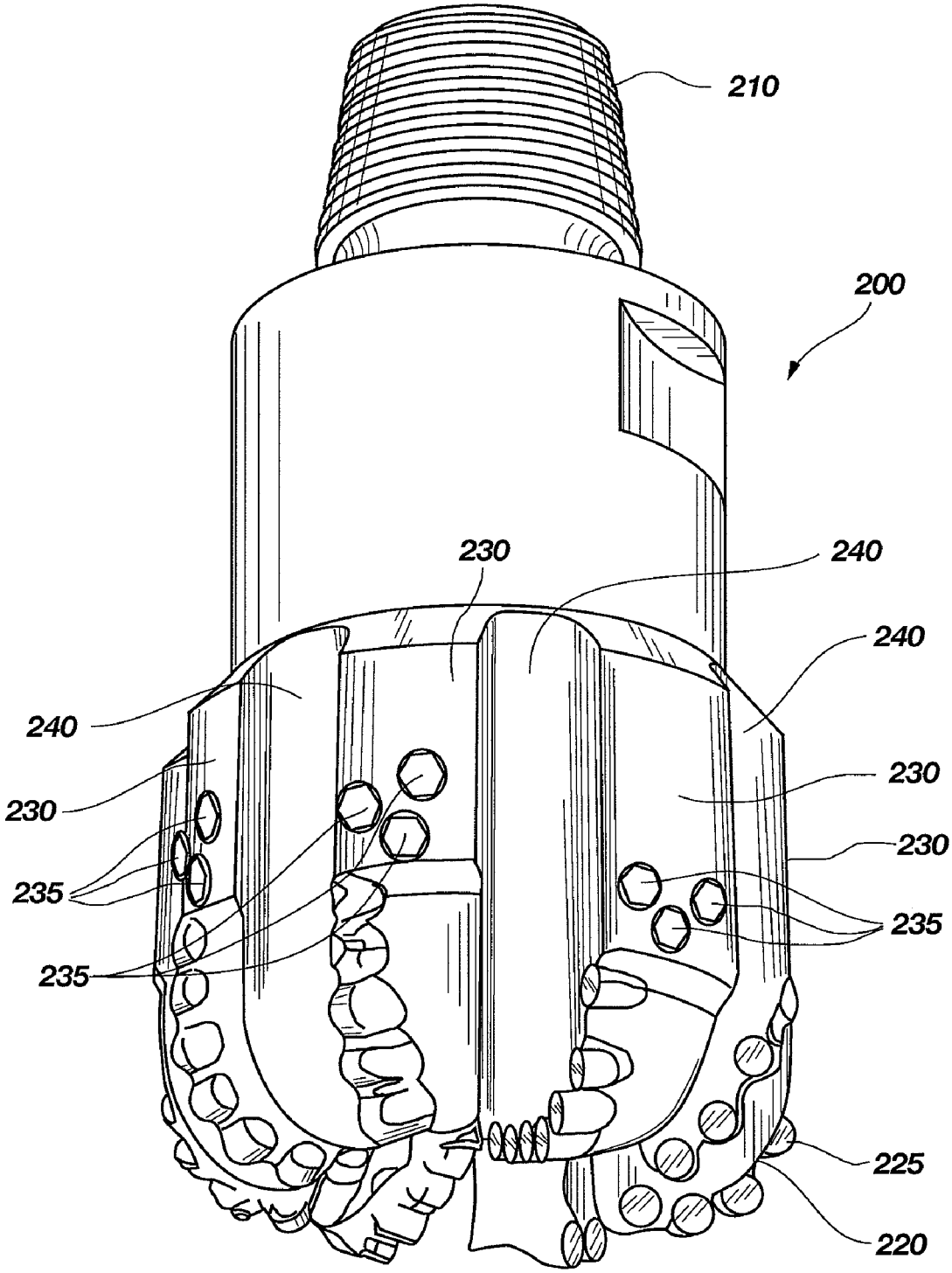
FIG. 2 is a perspective view of a conventional matrix-type rotary drag bit.

FIG. 2 is a perspective view of an example of a drill bit 200 of a fixed-cutter, or so-called "drag" bit, variety. Conventionally, the drill bit 200 includes threads at a shank 210 at the upper extent of the drill bit 200 for connection into the drillstring 140 (FIG. 1). At least one blade 220 (a plurality shown) at a generally opposite end from the shank 210 may be provided with a plurality of natural or synthetic diamond cutting elements in the form of polycrystalline diamond compact, or PDC cutting elements 225, arranged along the rotationally leading faces of the blades 220 to effect efficient disintegration of formation material as the drill bit 200 is rotated in the borehole 100 under applied weight on bit (WOB). A gage pad surface 230 extends upwardly from each of the blades 220, is proximal to, and generally contacts the sidewall of the borehole 100 (FIG. 1) during drilling operation of the drill bit 200. A plurality of channels 240, termed "junk slots," extend between the blades 220 and the gage pad surfaces 230 to provide a clearance area for removal of formation chips formed by the PDC cutting elements 225.

A plurality of gage inserts 235 is provided on the gage pad surfaces 230 of the drill bit 200. Shear cutting gage inserts 235 on the gage pad surfaces 230 of the drill bit 200, such as specially configured PDC cutting elements 225 provide the ability to actively shear formation material at the sidewall of the borehole 100 (FIG. 1) and to provide improved gage-holding ability in earth-boring bits of the fixed cutter variety. The drill bit 200 is illustrated as a polycrystalline diamond compact (PDC) bit, but the gage inserts 235 may be equally useful in other fixed-cutter or drag bits that include gage pad surfaces 230 for engagement with the sidewall of the borehole 100.

Those of ordinary skill in the art will recognize that the present invention may be embodied in a variety of drill bit types. The present invention possesses utility in the context of a so-called "tricone," or roller cone, rotary drill bit or other subterranean drilling tools as known in the art that may employ nozzles for delivering drilling mud to a cutting structure during use. Accordingly, as used herein, the term' "drill bit" includes and encompasses any and all rotary bits, including core bits, roller cone bits, fixed-cutter bits including PDC, natural diamond, thermally stable produced (TSP) synthetic diamond, and diamond impregnated bits without limitation, hybrid bits employing fixed cutting elements in combination with one or more roller-type cutters, eccentric bits, bicenter bits, reamers, reamer wings, as well as other earth-boring tools configured for acceptance of an electronics module 290 (FIG. 3A).

Figure 3A:
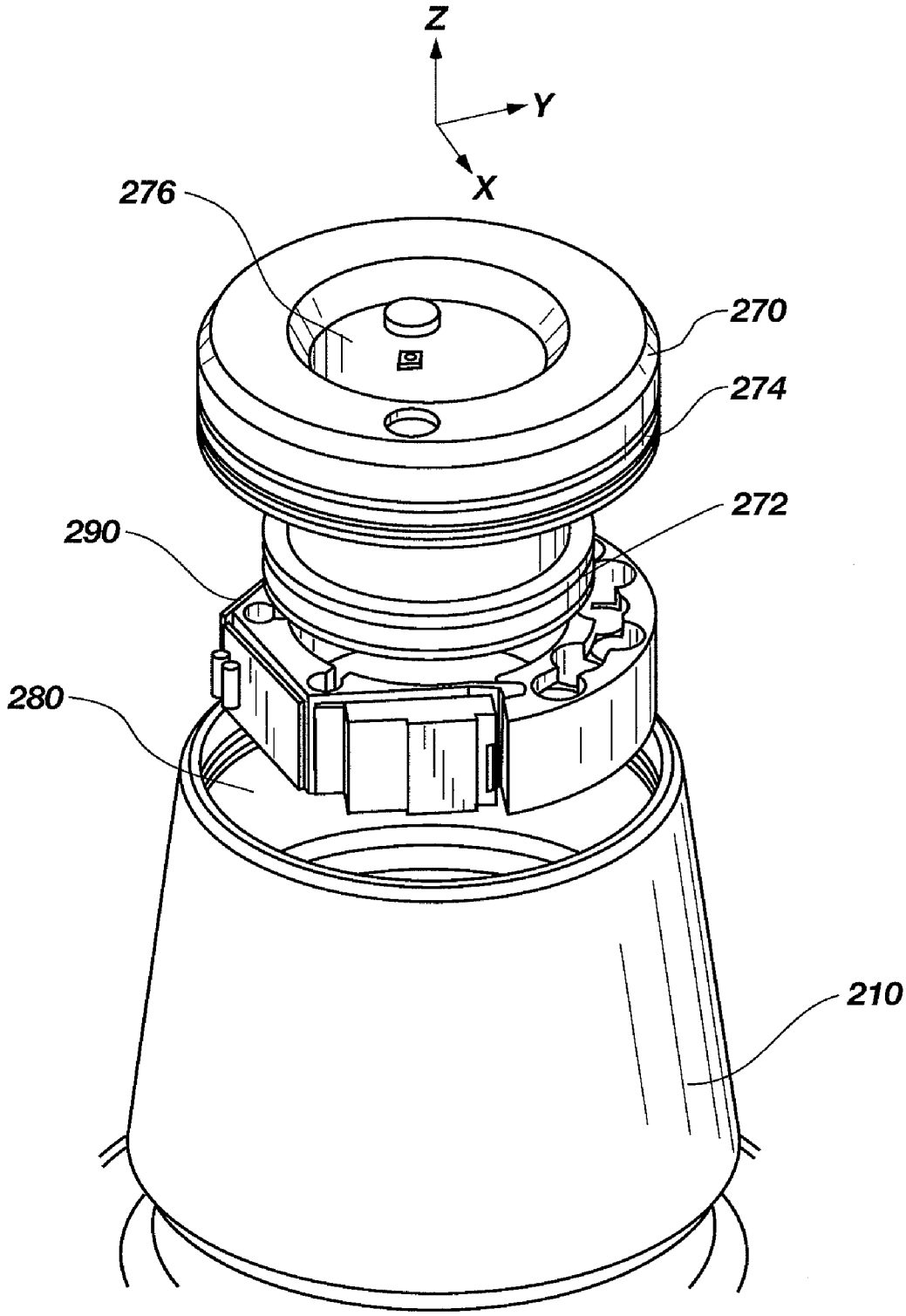
FIG. 3A is a perspective view of a shank, receiving an embodiment of an electronics module with an end-cap.
Figure 3B:
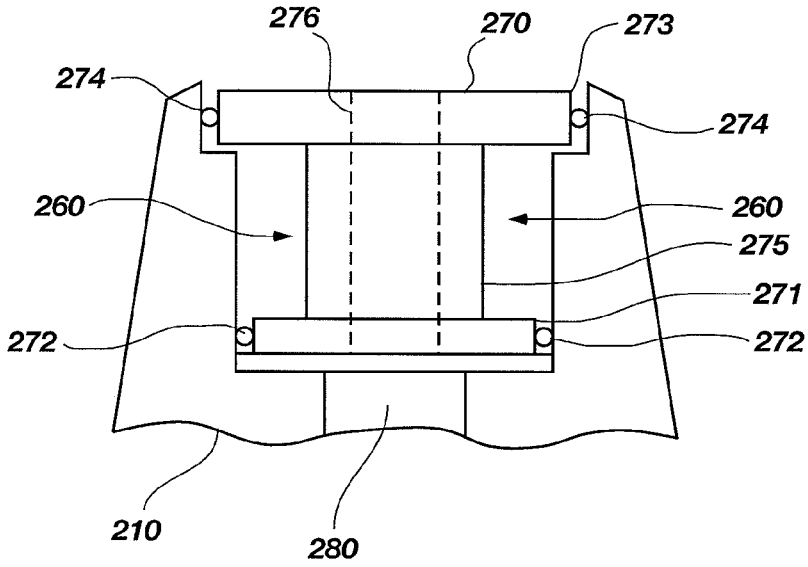
FIG. 3B is a cross-sectional view of a shank and an end-cap.

FIGS. 3A and 3B illustrate an embodiment of a shank 210 secured to a drill bit 200 (not shown), an end-cap 270, and an embodiment of an electronics module 290 (not shown in FIG. 3B). The shank 210 includes a central bore 280 formed through the longitudinal axis of the shank 210. In conventional drill bits 200, this central bore 280 is configured for allowing drilling mud to flow therethrough. In the present invention, at least a portion of the central bore 280 is given a diameter sufficient for accepting the electronics module 290 configured in a substantially annular ring, yet without substantially affecting the structural integrity of the shank 210. Thus, the electronics module 290 may be placed down in the central bore 280, about the end-cap 270, which extends through the inside diameter of the annular ring of the electronics module 290 to create a fluid tight annular chamber 260 (FIG. 3B) with the wall of central bore 280 and seal the electronics module 290 in place within the shank 210.

The end-cap 270 includes a cap bore 276 formed therethrough, such that the drilling mud may flow through the end-cap 270, through the central bore 280 of the shank 210 to the other side of the shank 210, and then into the body of drill bit 200. In addition, the end-cap 270 includes a first flange 271 including a first sealing ring 272, near the lower end of the end-cap 270, and a second flange 273 including a second sealing ring 274, near the upper end of the end-cap 270.

FIG. 3B is a cross-sectional view of the end-cap 270 disposed in the shank without the electronics module 290 (FIG. 4), illustrating the annular chamber 260 formed between the first flange 271, the second flange 273, the end-cap body 275, and the walls of the central bore 280. The first sealing ring 272 and the second sealing ring 274 form a protective, fluid tight, seal between the end-cap 270 and the wall of the central bore 280 to protect the electronics module 290 (FIG. 4) from adverse environmental conditions. The protective seal formed by the first sealing ring 272 and the second sealing ring 274 may also be configured to maintain the annular chamber 260 at approximately atmospheric pressure.

In the embodiment shown in FIGS. 3A and 3B, the first sealing ring 272 and the second sealing ring 274 are formed of material suitable for a high-pressure, high temperature environment, such as, for example, a Hydrogenated Nitrile Butadiene Rubber (HNBR) O-ring in combination with a PEEK back-up ring. In addition, the end-cap 270 may be secured to the shank 210 with a number of connection mechanisms such as, for example, a secure press-fit using sealing rings 272 and 274, a threaded connection, an epoxy connection, a shape-memory retainer, welded, and brazed. It will be recognized by those of ordinary skill in the art that the end-cap 270 may be held in place quite firmly by a relatively simple connection mechanism due to differential pressure and downward mud flow during drilling operations.

An electronics module 290 configured as shown in the embodiment of FIG. 3A may be configured as a flex-circuit board, enabling the formation of the electronics module 290 into the annular ring suitable for disposition about the end-cap 270 and into the central bore 280.

Figure 4:
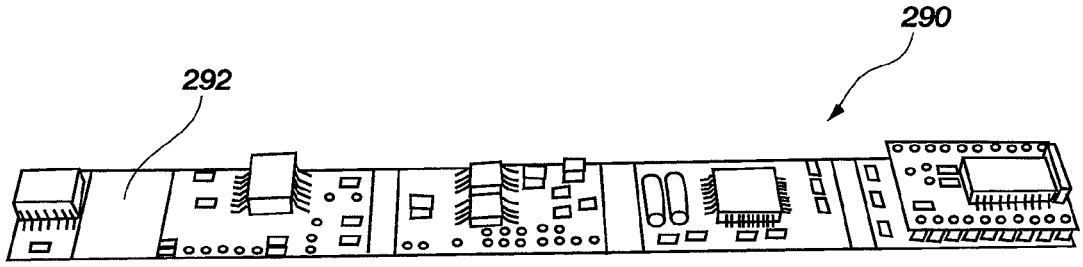
FIG. 4 is a drawing of an embodiment of an electronics module configured as a flex-circuit board enabling formation into an annular ring suitable for disposition in the shank of FIGS. 3A and 3B.

FIG. 4 illustrates this flex-circuit board embodiment of the electronics module 290 in a flat, uncurled configuration. The flex-circuit board 292 includes a high-strength reinforced backbone (not shown) to provide acceptable transmissibility of acceleration effects to sensors such as accelerometers. In addition, other areas of the flex-circuit board 292 bearing non-sensor electronic components may be attached to the end-cap 270 (FIGS. 3A and 3B) in a manner suitable for at least partially attenuating the acceleration effects experienced by the drill bit 200 (FIG. 1) during drilling operations using a material such as a visco-elastic adhesive.

Figure 5A:
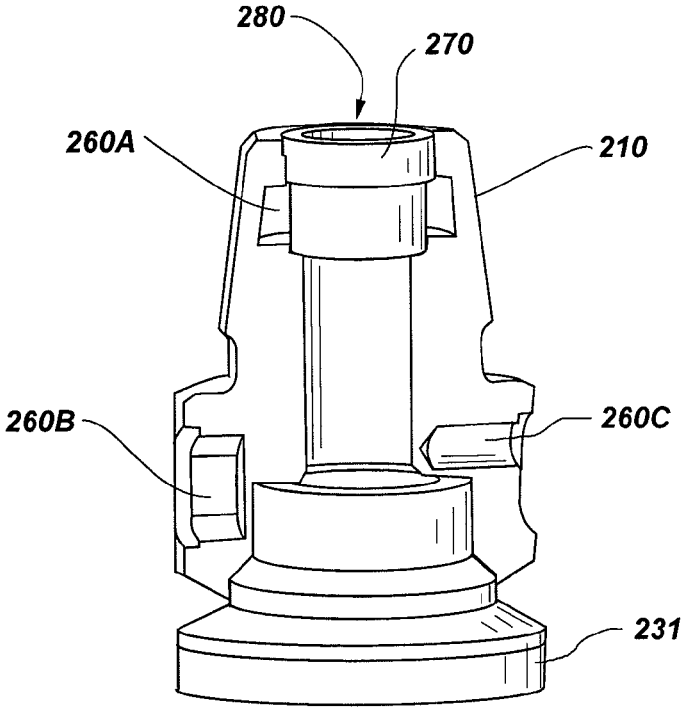
FIGS. 5A-5E are perspective views of a drill bit illustrating example locations in the drill bit wherein an electronics module, sensors, or combinations thereof may be located.

FIGS. 5A-5E are perspective views of portions of a drill bit illustrating examples of locations in the drill bit wherein an electronics module 290 (FIG. 4), sensors 340 (FIG. 6), or combinations thereof may be located. FIG. 5A illustrates the shank 210 of FIG. 3 secured to a bit body 231. In addition, the shank 210 includes an annular race 260A formed in the central bore 280. This annular race 260A may allow expansion of the electronics module 290 into the annular race 260A as the end-cap 270 is disposed into position.

FIG. 5A also illustrates two other alternate location for the electronics module 290, sensors 340, or combinations thereof. An oval cut out 260B, located behind the oval depression (may also be referred to as a torque slot) used for stamping the drill bit with a serial number may be milled out to accept the electronics. This area may then be capped and sealed to protect the electronics. Alternatively, a round cut out 260C located in the oval depression used for stamping the drill bit may be milled out to accept the electronics, then may be capped and sealed to protect the electronics.

Figure 5B:
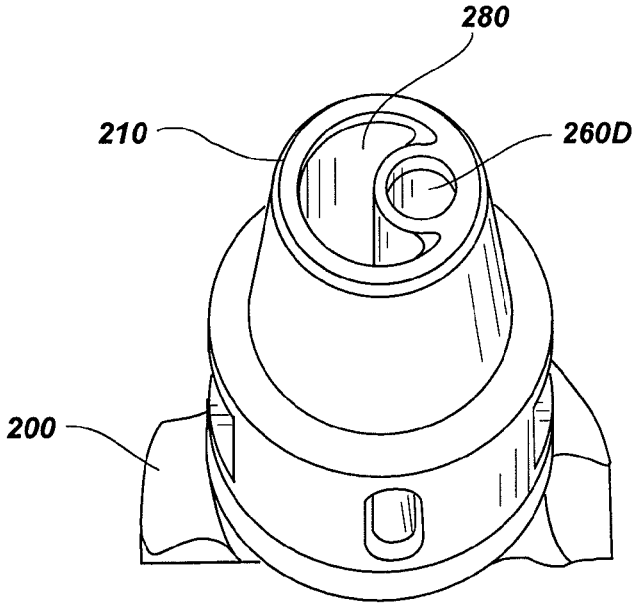

FIG. 5B illustrates an alternative configuration of the shank 210. A circular depression 260D may be formed in the shank 210 and the central bore 280 formed around the circular depression 260D, allowing transmission of the drilling mud. The circular depression 260D may be capped and sealed to protect the electronics within the circular depression 260D.

Figure 5C:
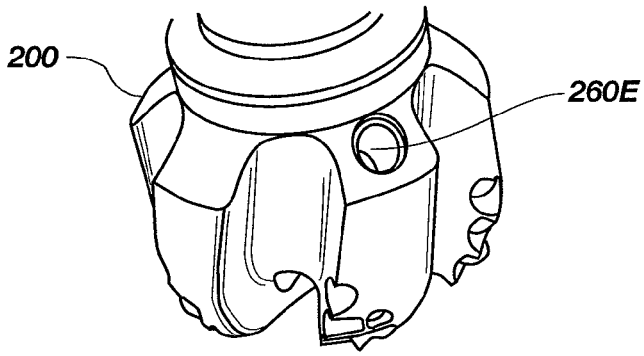
Figure 5D:
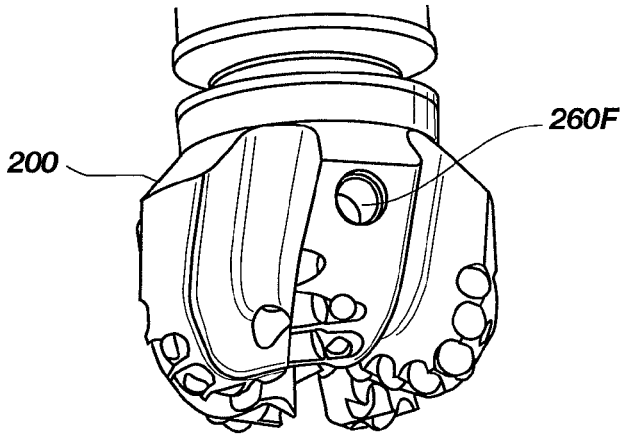
Figure 5E:
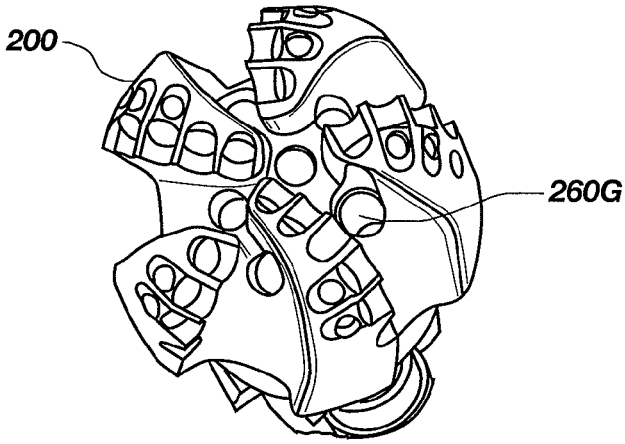

FIGS. 5C-5E illustrate circular depressions (260E, 260F, 260G) formed in locations on the drill bit 200. These locations offer a reasonable amount of room for electronic components while still maintaining acceptable structural strength in the blade.

An electronics module may be configured to perform a variety of functions. One embodiment of an electronics module 290 (FIG. 4) may be configured as a data evaluation module, which is configured for sampling data in different sampling modes, sampling data at different sampling frequencies, and analyzing data.

Figure 6:
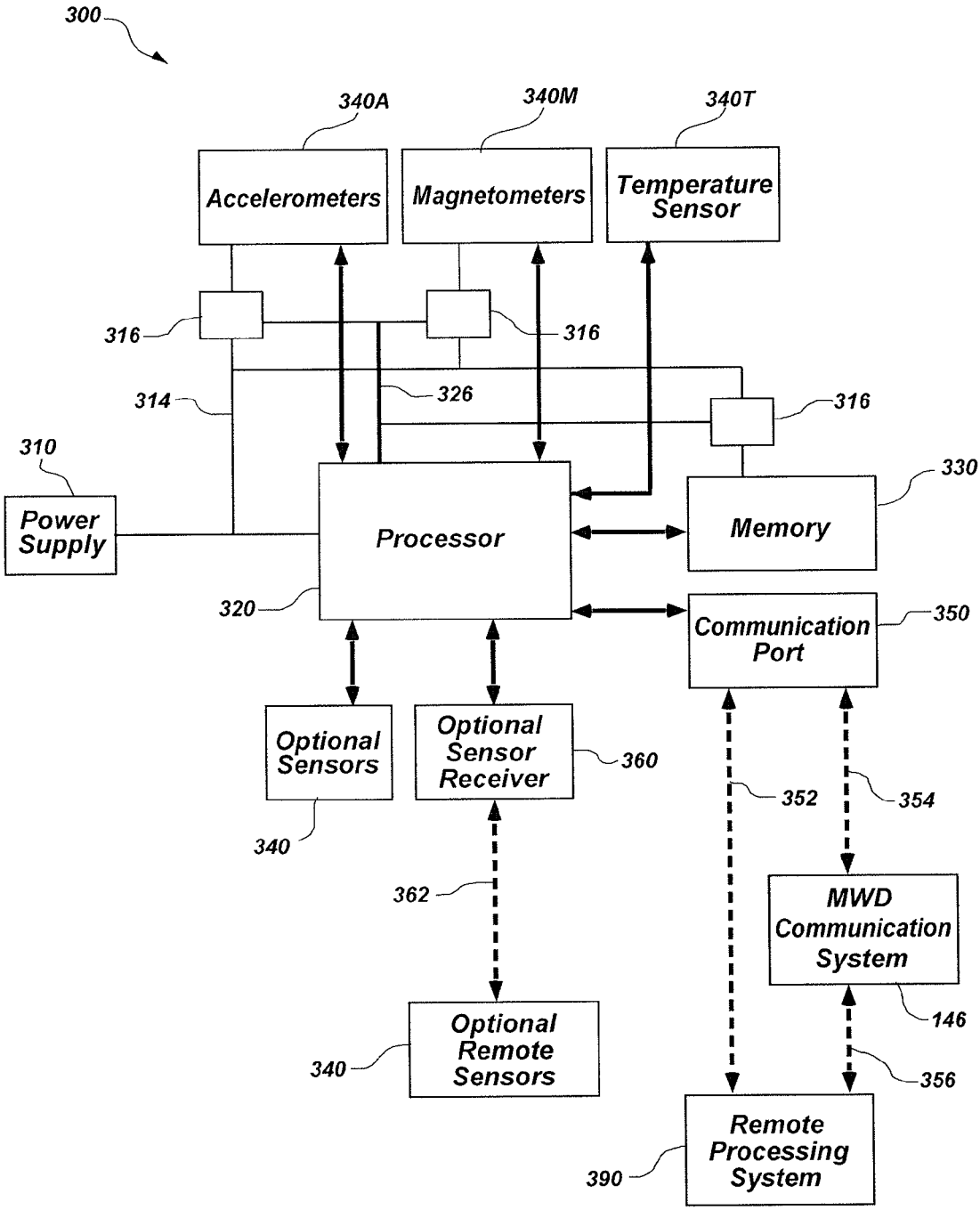
FIG. 6 is a block diagram of an embodiment of a data evaluation module according to the present invention.

FIG. 6 illustrates an embodiment of a data evaluation module 300. The data evaluation module 300 includes a power supply 310, a processor 320, a memory 330, and at least one sensor 340 configured for measuring a plurality of physical parameter related to a drill bit state, which may include drill bit condition, drilling operation conditions, and environmental conditions proximate the drill bit. In the embodiment of FIG. 6, the sensors 340 include a plurality of accelerometers 340A, a plurality of magnetometers 340M, and a temperature sensor 340T.

The magnetometers 340M of the FIG. 6 embodiment, when enabled and sampled, provide a measure of the orientation of the drill bit 200 (FIG. 1) along at least one of the three orthogonal axes relative to the earth's magnetic field. The data evaluation module 300 may include additional magnetometers 340M to provide a redundant system, wherein various magnetometers 340M may be selected, or deselected, in response to fault diagnostics performed by the processor 320.

The temperature sensor 340T may be used to gather data relating to the temperature of the drill bit 200, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 may be included as part of the data evaluation module 300. Some non-limiting examples of sensors that may be useful in the present invention are strain sensors at various locations of the drill bit, temperature sensors at various locations of the drill bit, mud (drilling fluid) pressure sensors to measure mud pressure internal to the drill bit, and borehole pressure sensors to measure hydrostatic pressure external to the drill bit. Sensors may also be implemented to detect mud properties, such as, for example, sensors to detect conductivity or impedance to both alternating current and direct current, sensors to detect influx of fluid from the hole when mud flow stops, sensors to detect changes in mud properties, and sensors to characterize mud properties such as synthetic-based mud and water-based mud.

These optional sensors 340 may include sensors 340 that are integrated with and configured as part of the data evaluation module 300. These sensors 340 may also include optional remote sensors 340 placed in other areas of the drill bit 200 (FIG. 2), or above the drill bit 200 in the bottom hole assembly. The optional sensors 340 may communicate using a direct-wired connection, or through an optional sensor receiver 360. The sensor receiver 360 is configured to enable wireless remote sensor communication across a wireless connection 362 over limited distances in a drilling environment as are known by those of ordinary skill in the art.

The memory 330 may be used for storing sensor data, signal processing results, long-term data storage, and computer instructions for execution by the processor 320. Portions of the memory 330 may be located external to the processor 320 and portions may be located within the processor 320. The memory 330 may include Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 6 embodiment, the memory 330 is a combination of SRAM in the processor (not shown), Flash memory 330 in the processor 320, and external Flash memory 330. Flash memory may be desirable for low power operation and the ability to retain information when no power is applied to the memory 330.

A communication port 350 may be included in the data evaluation module 300 for communication to external devices such as the MWD communication system 146 and a remote processing system 390. The communication port 350 may be configured for a direct communication link 352 to the remote processing system 390 using a direct wire connection or a wireless communication protocol, such as, by way of example only, infrared, BLUETOOTH®, and 802.11a/b/g protocols. Using the direct communication, the data evaluation module 300 may be configured to communicate with a remote processing system 390 such as, for example, a computer, a portable computer, and a personal digital assistant (PDA) when the drill bit 200 (FIG. 2) is not downhole. Thus, the direct communication link 352 may be used for a variety of functions, such as, for example, to download software and software upgrades, to enable setup of the data evaluation module 300 by downloading configuration data, and to upload sample data and analysis data. The communication port 350 may also be used to query the data evaluation module 300 for information related to the drill bit 200, such as, for example, bit serial number, data evaluation module serial number, software version, total elapsed time of bit operation, and other long-term drill bit data which may be stored in the NVRAM.

The communication port 350 may also be configured for communication with the MWD communication system 146 in a bottom hole assembly via a wired or wireless communication link 354 and protocol configured to enable remote communication across limited distances in a drilling environment as are known by those of ordinary skill in the art. One available technique for communicating data signals to an adjoining subassembly in the drillstring 140 (FIG. 1) is depicted, described, and claimed in U.S. Pat. No. 4,884,071 entitled "Wellbore Tool With Hall Effect Coupling," which issued on Nov. 28, 1989 to Howard, and the disclosure of which is incorporated in its entirety herein by reference.

The MWD communication system 146 may, in turn, communicate data from the data evaluation module 300 to a remote processing system 390 using mud pulse telemetry 356 or other suitable communication means suitable for communication across the relatively large distances encountered in a drilling operation.

The processor 320 in the embodiment of FIG. 6 is configured for processing, analyzing, and storing collected sensor data. For sampling of the analog signals from the various sensors 340, the processor 320 of this embodiment includes a digital-to-analog converter (DAC). However, those of ordinary skill in the art will recognize that the present invention may be practiced with one or more external DACs in communication between the sensors 340 and the processor 320. In addition, the processor 320 in the embodiment includes internal SRAM and NVRAM. However, those of ordinary skill in the art will recognize that the present invention may be practiced with memory 330 that is only external to the processor 320, as well as in a configuration using no external memory 330 and only memory 330 internal to the processor 320.

The embodiment of FIG. 6 uses battery power as the operational power supply 310. Battery power enables operation without consideration of connection to another power source while in a drilling environment. However, with battery power, power conservation may become a significant consideration in the present invention. As a result, a low power processor 320 and low power memory 330 may enable longer battery life. Similarly, other power conservation techniques may be significant in the present invention.

The embodiment of FIG. 6, illustrates power controllers 316 for gating the application of power to the memory 330, the accelerometers 340A, and the magnetometers 340M. Using these power controllers 316, software running on the processor 320 may manage a power control bus 326 including control signals for individually enabling a voltage signal 314 to each component connected to the power control bus 326. While the voltage signal 314 is shown in FIG. 6 as a single signal, it will be understood by those of ordinary skill in the art that different components may require different voltages. Thus, the voltage signal 314 may be a bus including the voltages necessary for powering the different components.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, one example of a Cartesian coordinate system, shown in FIG. 3A, defines a z-axis along the longitudinal axis about which the drill bit 200 rotates, an x-axis perpendicular to the z-axis, and a y-axis perpendicular to both the z-axis and the x-axis, to form the three orthogonal axes of a typical Cartesian coordinate system. Because the data evaluation module 300 may be used while the drill bit 200 is rotating and with the drill bit 200 in other than vertical orientations, the coordinate system may be considered a rotating Cartesian coordinate system with a varying orientation relative to the fixed surface location of the drilling rig 110 (FIG. 1).

The accelerometers 340A of the FIG. 6 embodiment, when enabled and sampled, provide a measure of acceleration of the drill bit along at least one of the three orthogonal axes. The data evaluation module 300 may include additional accelerometers 340A to provide a redundant system, wherein various accelerometers 340A may be selected, or deselected, in response to fault diagnostics performed by the processor 320. Furthermore, additional accelerometers may be used to determine additional information about bit dynamics and assist in distinguishing lateral accelerations from angular accelerations.

Figure 7:
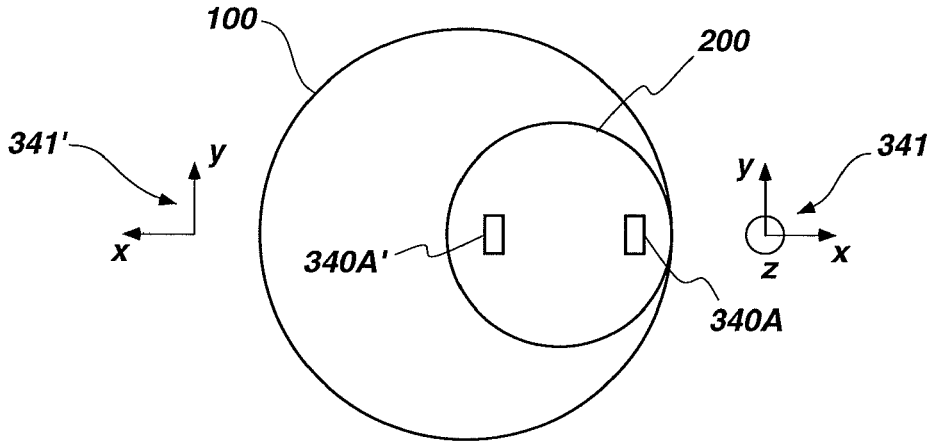
FIG. 7 illustrates placement of multiple accelerometers.

FIG. 7 is a top view of a drill bit 200 within a borehole 100. As can be seen, FIG. 7 illustrates the drill bit 200 offset within the borehole 100, which may occur due to bit behavior other than simple rotation around a rotational axis. FIG. 7 also illustrates placement of multiple accelerometers with a first set of accelerometers 340A positioned at a first location. A second set of accelerometers 340A' positioned at a second location within the bit body may also be included. By way of example, the first set of accelerometers 340A includes a first coordinate system 341 with x, y, and z accelerometers, while the second set of accelerometers 340A' includes a second coordinate system 341' with x and y accelerometers. These axes of the coordinate systems and may also be referred to herein as axial (z-axis), tangential (y-axis), and radial (x-axis). Thus, there may be one or more radial accelerometers, one or more tangential accelerometers, and an axial accelerometer. Of course, other embodiments may include three coordinates in the second set of accelerometers as well as other configurations and orientations of accelerometers alone or in multiple coordinate sets.

With the placement of a second set of accelerometers at a different location on the drill bit, differences between the accelerometer sets may be used to distinguish lateral accelerations from angular accelerations. For example, if the two sets of accelerometers are both placed at the same radius from the rotational center of the drill bit 200 and the drill bit 200 is only rotating about that rotational center, then the two accelerometer sets will experience the same angular rotation. However, the drill bit may be experiencing more complex behavior, such as, for example, bit whirl (forward or backward), bit walking, and lateral vibration. These behaviors include some type of lateral motion in combination with the angular motion. For example, as illustrated in FIG. 7, the drill bit 200 may be rotating about its rotational axis and at the same time, walking around the larger circumference of the borehole 100. In these types of motion, the two sets of accelerometers disposed at different places will experience different accelerations. With the appropriate signal processing and mathematical analysis, the lateral accelerations and angular accelerations may be more easily determined with the additional accelerometers.

Furthermore, if initial conditions are known or can be estimated, bit velocity profiles and bit trajectories may be inferred by mathematical integration of the accelerometer data using conventional numerical analysis techniques.

Figure 8:
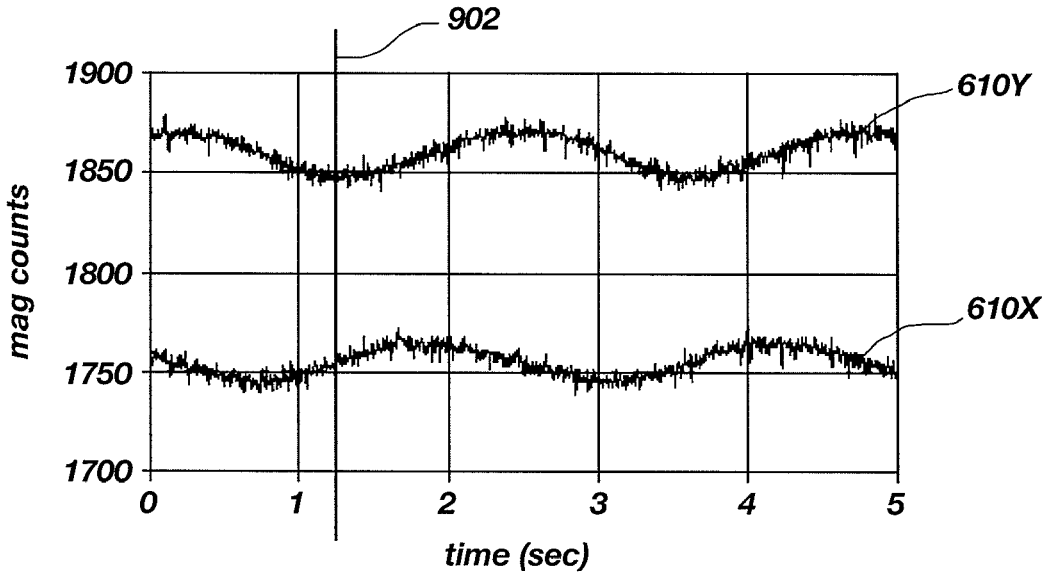
FIG. 8 illustrates examples of data sampled from magnetometer sensors along two axes of a rotating Cartesian coordinate system.

Referring to FIG. 8, magnetometer samples histories are shown for X magnetometer samples 610X and Y magnetometer samples 610Y. Looking at sample point 902, it can be seen that the Y magnetometer samples 610Y are near a minimum and the X magnetometer samples 610X are at a phase of about 90 degrees. By tracking the history of these samples, the software can detect when a complete revolution has occurred. For example, the software can detect when the X magnetometer samples 610X have become positive (i.e., greater than a selected value) as a starting point of a revolution. The software can then detect when the Y magnetometer samples 610Y have become positive (i.e., greater than a selected value) as an indication that revolutions are occurring. Then, the software can detect the next time the X magnetometer samples 610X become positive, indicating a complete revolution. As a non-limiting example, each time a revolution occurs, the logging operation may update various logging variables, perform data compression operations, communicate data, communicate events, or combinations thereof.

Figure 9:
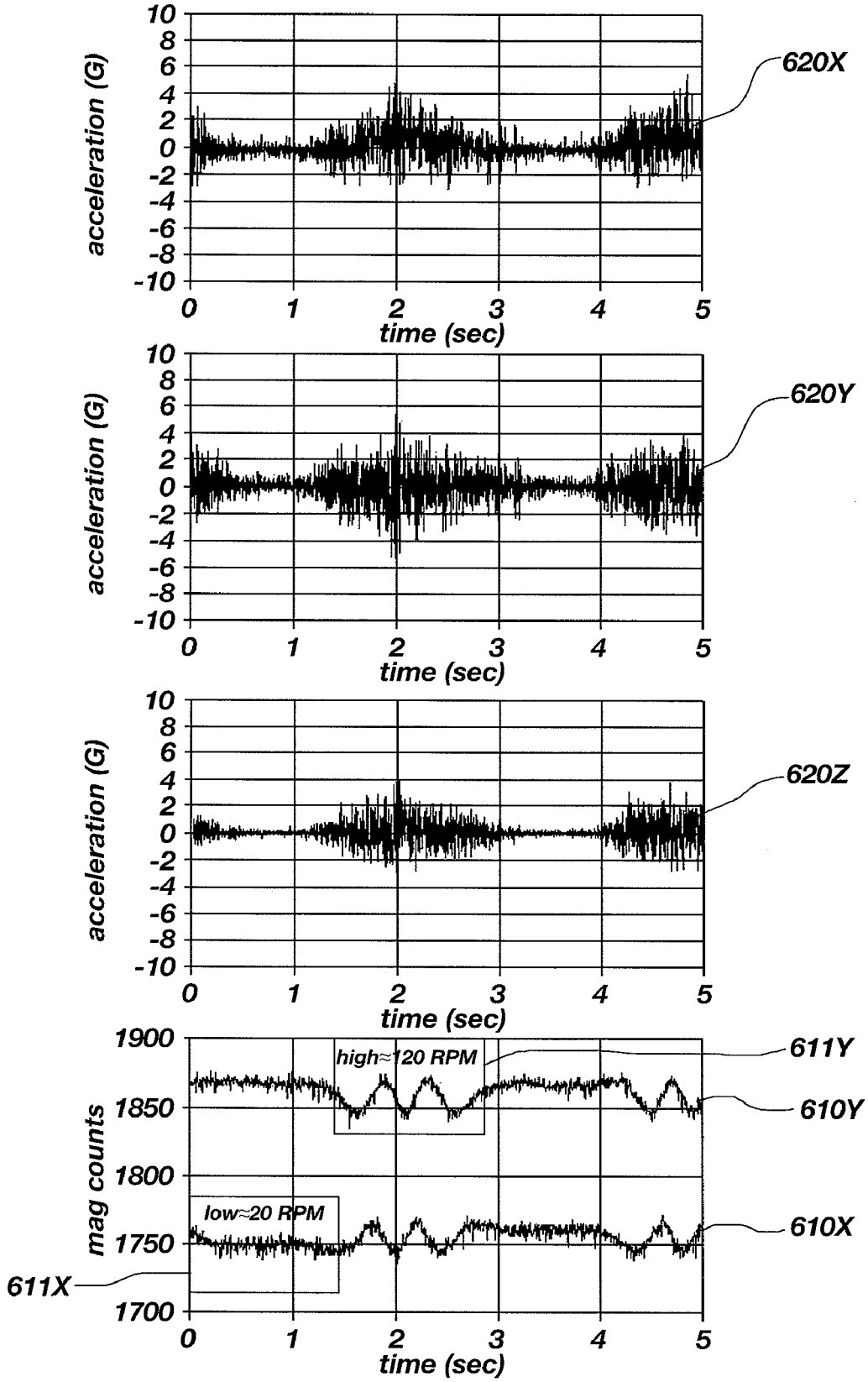
FIG. 9 illustrates examples of data sampled from accelerometer sensors and magnetometer sensors along three axes of a Cartesian coordinate system that is static with respect to the drill bit, but rotating with respect to a stationary observer.

FIG. 9 illustrates examples of types of data that may be collected by the data evaluation module 300 (FIG. 6). These figures illustrate an example of how accelerometer data (also referred to herein as acceleration information) and magnetometer data may appear during torsional oscillation. Initially, the magnetometer measurements 610Y and 610X (also referred to herein as magnetometer information) illustrate a rotational speed of about 20 revolutions per minute (RPM) as shown by box 611X. This low RPM may be indicative of the drill bit binding on some type of subterranean formation. The magnetometers then illustrate a large increase in rotational speed, to about 120 RPM as shown by box 611Y. This high RPM may be indicative of the drill bit being freed from the binding force. This increase in rotation is also illustrated by the accelerometer measurements for radial acceleration 620X, tangential acceleration 620Y, and axial acceleration 620Z.

As stated earlier, the present invention includes methods and apparatuses to develop information related to cutting performance and condition of the drill bit. As non-limiting examples, the cutting performance and drill bit condition information may be used to determine when a drill bit is near its end of life and should be changed and when drilling operations should be changed to extend the life of the drill bit. The cutting performance and drill bit condition information from an existing drill bit may also be used for developing future improvements to drill bits.

Software, which may also be referred to as firmware, for the data evaluation module 300 (FIG. 6) comprises computer instructions for execution by the processor 320. The software may reside in an external memory 330, or memory within the processor 320.

As is explained more fully below with reference to specific types of data gathering, software modules may be devoted to memory management with respect to data storage. The amount of data stored may be modified with adaptive sampling and data compression techniques. For example, data may be originally stored in an uncompressed form. Later, when memory space becomes limited, the data may be compressed to free up additional memory space. In addition, data may be assigned priorities such that when memory space becomes limited, high priority data is preserved and low priority data may be overwritten.

One such data compression technique, which also enables additional analysis of drill bit conditions, is converting the raw accelerometer data to Root Mean Square (gRMS) acceleration data. This conversion reduces the amount of data and also creates information indicative of the energy expended in each of the accelerometer directions.

As is well known in the art, gRMS acceleration is the square root of the averaged sum of squared accelerations over time. As the data evaluation module collects acceleration samples it generates an acceleration history of acceleration over time. This acceleration history may be squared and then averaged to determine a mean-square acceleration over an analysis period. Thus, gRMS is the square root of the mean square acceleration. As used herein RMS acceleration and gRMS may be used interchangeably. In general, gRMS may be referred to herein as RMS acceleration to indicate the RMS acceleration at a specific point, or RMS acceleration history to refer to the collection of RMS acceleration over time. Furthermore, RMS acceleration history may generically refer to either or both RMS tangential acceleration history and RMS radial acceleration history.

Figure 10A:
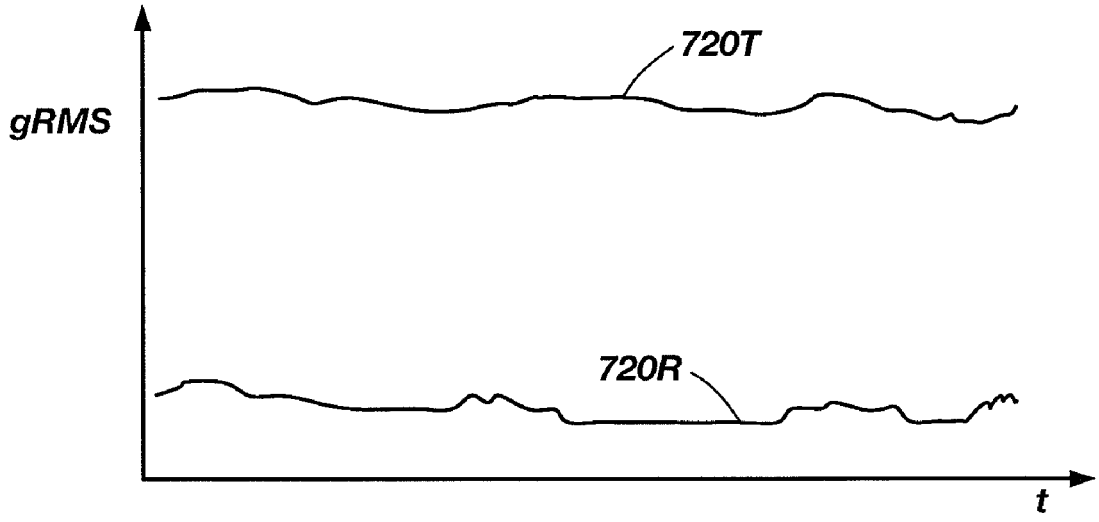
FIGS. 10A and 10B illustrate possible Root Mean Square (RMS) values for radial RMS acceleration and tangential RMS acceleration over relatively short periods of time.
Figure 10B:
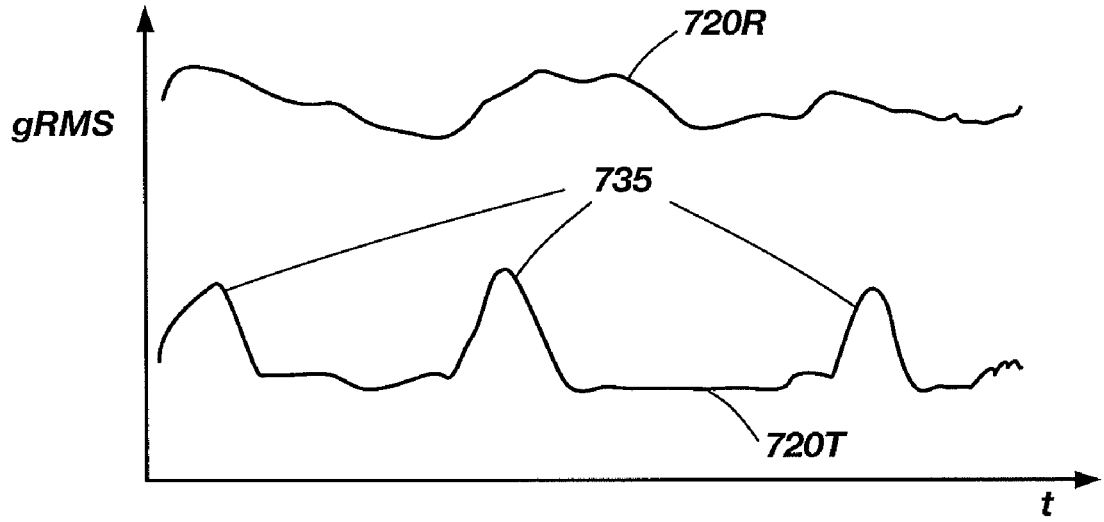

FIGS. 10A and 10B illustrate possible RMS values for RMS radial acceleration 720R and RMS tangential acceleration 720T over relatively short periods of time, for example, over a few minutes or hours. In FIG. 10A a tangential dominant state exists, wherein the RMS tangential acceleration 720T is significantly higher than the RMS radial acceleration 720R. A tangential dominant state generally indicates a good cutting action and contact of the gage pads with the well bore because most of the energy is expended in the tangential direction, i.e., cutting action, rather than in the radial direction.

FIG. 10B, on the other hand, indicates a radial dominant state, which may be indicative of a whirling or sliding action rather than a consistent cutting action. In the radial dominant state, the RMS radial acceleration 720R is near or larger that the RMS tangential acceleration 720T. The peaks 735 in the RMS tangential acceleration 720T may be indicative of points when the cutters grab and some cutting occurs, whereas the low areas between the peaks 735 may be indicative of when the drill bit is sliding or whirling. Embodiments of the present invention may use raw accelerometer data and RMS acceleration data. In addition, other information derived from the raw accelerometer data may be used, such as, for example, filtered data, compressed data, and other information derived from data processing and reduction techniques.

Embodiments of the present invention provide estimations and projections of wear on the gage pads 230 (FIG. 2) of the drill bit 200. The gage pads 230 (FIG. 2) will wear over time as the drill bit cuts away material in the borehole. As stated above, RPM of the drill bit (also be referred to herein as revolution rate) may be derived from a combination of the radial accelerometers and the tangential accelerometers. In addition, information from the magnetometers may be used to determine RPM of the drill bit or used in combination with the accelerometers to determine RPM of the drill bit.

Gage pad wear is dependent on the distance the gage pad 230 travels while in contact with the well bore, the surface area of the gage pads 230 in contact with the well bore, and material properties of the formation through which the drill bit is cutting. As a non-limiting example, formation hardness affects the coefficient of friction between the formation and gage pad and, as a result, the amount of wear experienced by the gage pads as they drag against the formation.

Gage pad distance from the center of the drill bit (i.e., the radius R) is known and a distance traveled by the gage pad for each revolution is given as $2\pi R$. Therefore, the distance traveled by the gage pads 230 may be derived as a function of RPM, as is well known by those of ordinary skill in the art.

Software modules may be included to track the long-term history of the drill bit. Thus, based on drilling performance data gathered over the lifetime of the drill bit, a life estimate of the drill bit may be formed. Failure of a drill bit can be a very expensive problem. With life estimates based on actual drilling performance data, the software module may be configured to determine different states of gage pad wear and determine when a drill bit is nearing the end of its useful life. A result of this analysis may be communicated through the communication port 350 (FIG. 6) to external devices, a rig operator, or a combination thereof.

Figure 11:
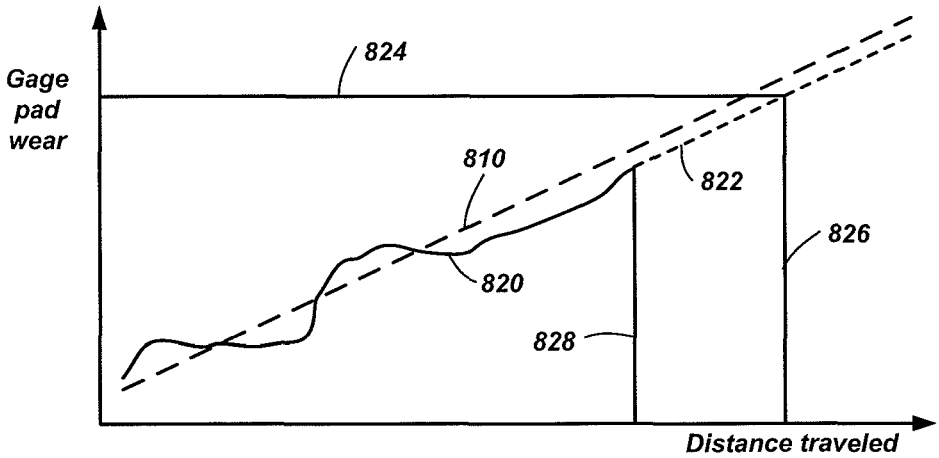
FIG. 11 is a graph illustrating a possible gage-pad-wear history over a distance traveled by the gage pads.

FIG. 11 is a graph illustrating a possible gage-pad-wear history over a distance traveled by the gage pads. Dashed line 810 indicates a theoretical gage-pad-wear history for a constant RPM when the gage pads are always in contact with the well bore and a consistent formation hardness. Line 820 indicates an estimated gage-pad-wear history that may be present due to variations in RPM, how often the gage pads are in contact with the well bore, and variation in formation hardness. As can be seen, the gage pad wear 820 may deviate from the theoretical dashed line 810 over the distance traveled (also referred to herein as a distance profile). The gage pad wear 820 may also be referred to as a gage-pad-wear history or a gage-pad-wear state to indicate a specific point within the gage-pad-wear history. Embodiments of the present invention estimate what this gage-pad-wear history will be based on distance traveled, bit behavior as determined from accelerometer information, and formation hardness information, and combinations thereof.

One gage-pad-wear state may be defined as a critical wear amount 824. As a non-limiting example, a wear state on the gage pads of about 0.25 inch may be a critical wear amount 824. When the gage-pad-wear state reaches the critical wear amount 824, a wear limit 826 may be defined as a time, a distance, or a combination thereof, when the gage pads reach a wear state wherein it may be advisable to change the drill bit. Of course, the distance may be defined as a number of revolutions, a distance traveled by the gage pads, or other distance measurement for the drill bit, such as a depth achieved by the drill bit.

Line 828 indicates a current distance traveled for the gage pads. Beyond line 828, an extrapolated wear profile 822 for the gage pads may be determined by extrapolating the gage-pad-wear history 820 to what type of wear may occur over a future depth, a future time, a future distance, or a combination thereof.

Figure 12A:
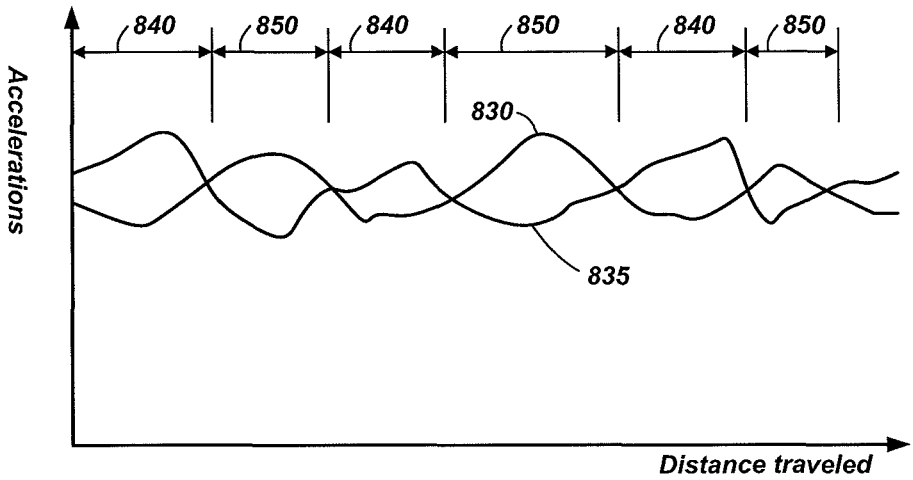
FIG. 12A is a graph of tangential acceleration history and radial acceleration history as a drill bit rotates within a borehole.

FIG. 12A is a graph of tangential acceleration history 830 and radial acceleration history 835 as a drill bit rotates within the borehole. As the drill bit rotates in the well bore some of the time the gage pads may be in contact and cutting into the well bore with the drill bit rotating forward. At other times, the gage pads may not be in contact with the well bore or the drill bit may be rotating backward or in some other dysfunctional state wherein the gage pads are not cutting against the well bore. The tangential accelerometer history 830 and radial accelerometer history 835 may be used to give an indication of when the gage pads are cutting and when they are not cutting.

As a non-limiting example, a gage-cutting period 840 may be defined as when the tangential accelerometer history 830 is larger than the radial accelerometer history 835. Similarly, a gage-slipping period 850 may be defined as when the tangential accelerometer history 830 is smaller than the radial accelerometer history 835. Of course, those of ordinary skill in the art will recognize that other threshold limits may be defined for the gage-cutting period 840 and gage-slipping period 850. As a non-limiting example, a specific acceleration level may be defined for each of the tangential and radial accelerations to define cutting and slipping periods rather than the simple crossover point. In addition, rather than thresholds, gage-cutting periods 840 and gage-slipping periods 850 may be determined and given varying weights based on, as a non-limiting example, differences between tangential accelerometer readings and radial accelerometer readings.

When the gage pads are cutting, there may be significant wear on the gage pads, whereas when the gage pads are slipping, there may be little or no wear on the gage pads. Thus, one can estimate the gage-pad-wear history 820 more accurately by taking into account these gage-cutting periods 840 and gage-slipping periods 850.

Figure 12B:
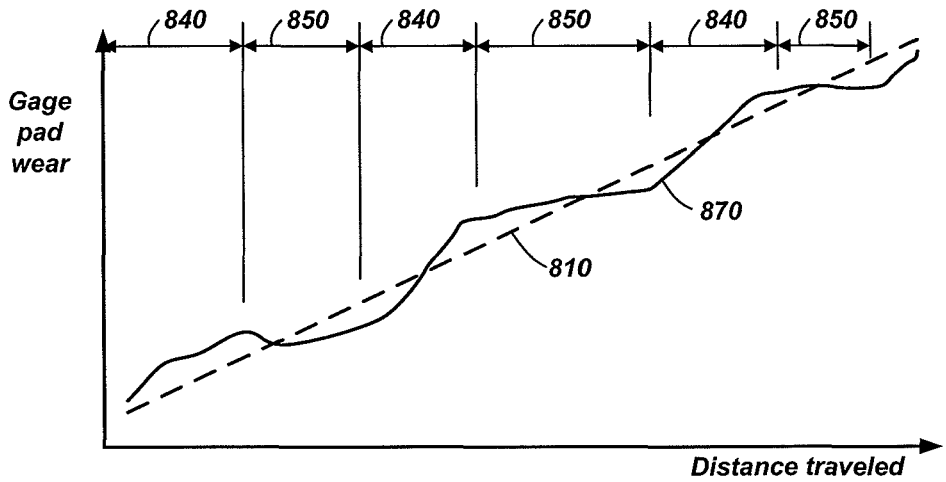
FIG. 12B is a graph illustrating a possible gage-pad-wear history responsive to changes in drilling conditions over a distance traveled by the gage pads.

FIG. 12B is a graph illustrating a possible gage-pad-wear history responsive to changes in drilling conditions over a distance traveled by the gage pads. The gage-cutting periods 840 and gage-slipping periods 850 from FIG. 12A are repeated in FIG. 12B. Once again, dashed line 810 indicates a theoretical gage-pad-wear history for a constant RPM when the gage pads are always in contact with the well bore and a consistent formation hardness. Line 870 indicates an estimate of gage pad wear taking into account variations in RPM and the gage-cutting periods 840 and gage-slipping periods 850. As can be seen, the estimate may have a higher slope indicating more substantial wear for distance traveled during gage-cutting periods 840. In contrast, a lower slope during gage-slipping periods 850 indicates an estimate of a small amount of wear during gage-slipping periods 850. By taking into account gage-cutting periods 840 and gage-slipping periods 850, a more accurate estimate of the amount of wear may be obtained over the history of the drill bit.

While not illustrated in FIG. 12B, those of ordinary skill in the art will recognize that the critical wear amount 824 from FIG. 11, as well as the wear limit 826 and extrapolated wear profile 822 are equally applicable to FIG. 12B.

Figure 13A:
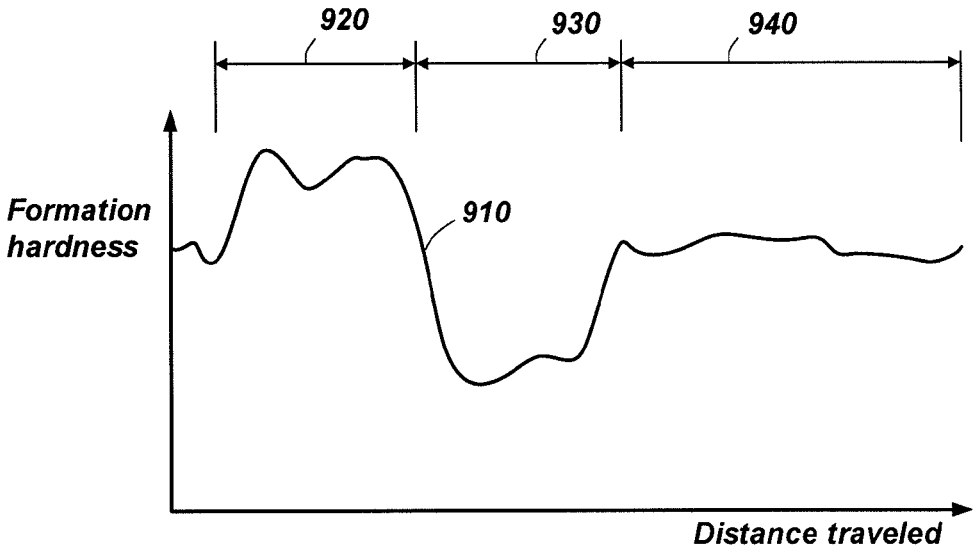
FIG. 13A is a graph of changes in formation hardness as a drill bit traverses down the borehole.

FIG. 13A is a graph of changes in formation hardness as a drill bit traverses down the borehole. The rate at which gage pads wear is related to the coefficient of friction and the hardness of the material they are cutting. Embodiments of the present invention may include an estimate of formation hardness information that is included in the data evaluation module 300 (FIG. 6) prior to drilling. In other embodiments, current formation hardness derived from general lithology information may be communicated to the data evaluation module 300 from other devices on the drillstring or from the surface. In FIG. 13A, variations in formation hardness information 910 are shown as the distance traveled by the gage pads (e.g., by correlating to distance traveled downhole and RPM). For ease of description, and not limitation, a high hardness segment 920, a low hardness segment 930, and an intermediate hardness segment 940 are shown for the formation hardness information.

Figure 13B:
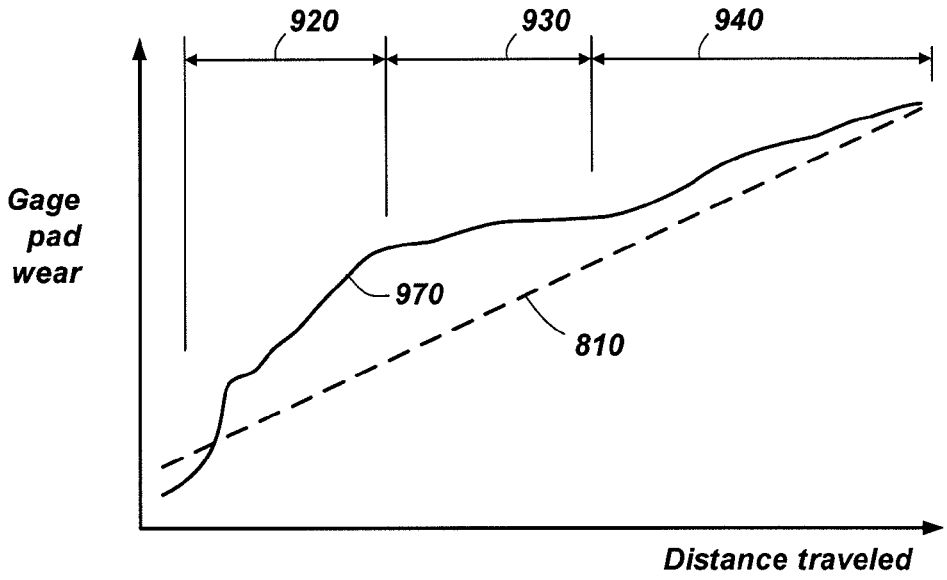
FIG. 13B is a graph illustrating a possible gage-pad-wear history responsive to formation hardness changes over a distance traveled by the gage pads.

FIG. 13B is a graph illustrating a possible gage-pad-wear history 970 responsive to formation hardness changes over a distance traveled by the gage pads. The high hardness segment 920, low hardness segment 930, and intermediate hardness segment 940 are repeated in FIG. 13B. Once again, dashed line 810 indicates a theoretical gage-pad-wear history for a constant RPM when the gage pads are always in contact with the well bore and a consistent formation hardness. Line 970 indicates an estimate of gage pad wear taking into account variations in RPM and current formation hardness.

As can be seen by line 970, when the gage pads are cutting hard materials during the high hardness segment 920, the slope of the gage-pad-wear history 970 may be relatively steep because the gage pads are wearing relatively quickly for a given distance traveled by the gage pads. In contrast, the slope of the gage-pad-wear history 970 may be relatively shallow during the low hardness segment 930 because the gage pads are wearing relatively slowly for a given distance traveled when cutting soft formations. During the intermediate hardness segment 940, the slope of the gage-pad-wear history 970 may be somewhere between that of the high hardness segment 920 and the low hardness segment 930.

While not illustrated in FIG. 13B, those of ordinary skill in the art will recognize that the critical wear amount 824 from FIG. 11, as well as the wear limit 826 and extrapolated wear profile 822 are equally applicable to FIG. 13B.

The gage pad wear, acceleration histories, RPM information, or combinations thereof, may be periodically reported to an operator or equipment on the surface via the communication port 350 (FIG. 6). The operator may wish to modify the drilling conditions based on the gage pad wear. As a non-limiting example, when gage pad wear becomes pronounced, the operator may wish to prolong the life of the drill bit by modifying one or more drilling parameters such as, for example, torque, rotational velocity, and weight on bit. Of course, this drilling parameter modification may mean less energy is expended in drilling and the rate of penetration may decrease such that the depth drilled for a given amount of wear may not be significantly different. However, it would give the operator a means for extending the elapsed-time life of the drill bit in a case, for example, when another drill bit is not readily available to be switched in for the soon-to-be worn drill bit, or when a worn drill bit is close to its target depth and one or more drilling parameters may be modified to reach target depth at a lesser rate of penetration that may, nonetheless, avoid the time and expense of tripping the drill bit out of the wellbore for replacement by another drill bit for the short, remaining interval to be drilled.

While the present invention has been described herein with respect to certain preferred embodiments, those of ordinary skill in the art will recognize and appreciate that it is not so limited. Rather, many additions, deletions, and modifications to the preferred embodiments may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. A drill bit for drilling a subterranean formation, comprising:

a bit body bearing at least one gage pad and adapted for coupling to a drillstring;

a set of accelerometers disposed in the drill bit and comprising a radial accelerometer for sensing radial acceleration of the drill bit and a tangential accelerometer for sensing tangential acceleration of the drill bit; and a data evaluation module operably coupled to the set of accelerometers and disposed in the drill bit and comprising a processor, a memory, and a communication port, the data evaluation module configured for:

sampling acceleration information from the radial accelerometer and the tangential accelerometer over an analysis period;

storing the acceleration information in the memory to generate an acceleration history;

analyzing the acceleration history to determine a distance traveled by the at least one gage pad;

analyzing the acceleration history to determine at least one gage-cutting period and at least one gage-slipping period; and estimating a gage pad wear responsive to the analysis of the distance traveled, the at least one gage-cutting period and the at least one gage-slipping period.

2. The drill bit of claim 1, wherein the data evaluation module is further configured to:

determine the at least one gage-cutting period as a time period when the tangential acceleration is larger than the radial acceleration; and determine the at least one gage-slipping period as a time period when the radial acceleration is larger than the tangential acceleration.

3. The drill bit of claim 1, wherein the data evaluation module is further configured to report the gage pad wear through the communication port.

4. The drill bit of claim 1, wherein the data evaluation module is further configured for:

forming a gage-pad-wear history by repeating the estimating the gage pad wear over the analysis period; and reporting the gage-pad-wear history through the communication port.

5. The drill bit of claim 4, wherein the data evaluation module is further configured for:

extrapolating the gage-pad-wear history to determine a wear limit when the gage pad wear will approach a critical wear amount at a future time, a future depth, or a combination thereof; and reporting the wear limit through the communication port.

6. The drill bit of claim 1, further comprising an X magnetometer and a Y magnetometer operably coupled to the data evaluation module and wherein the data evaluation module is further configured for:

sampling magnetometer information from the X magnetometer and the Y magnetometer over the analysis period; and including the magnetometer information to determine the distance traveled.

7. The drill bit of claim 1, wherein the data evaluation module is further configured for receiving formation hardness information through the communication port and wherein the estimating the gage pad wear further comprises including the formation hardness information in the analysis of the distance traveled, the at least one gage-cutting period and the at least one gage-slipping period.

8. A drill bit for drilling a subterranean formation, comprising:

a bit body bearing at least one gage pad and adapted for coupling to a drillstring;

at least one radial accelerometer for sensing radial acceleration of the drill bit and at least one tangential accelerometer for sensing tangential acceleration of the drill bit; and a data evaluation module operably coupled to the set of accelerometers and disposed in the drill bit and comprising a processor, a memory, and a communication port, the data evaluation module configured for:

receiving formation hardness information through the communication port;

sampling acceleration information from the at least one radial accelerometer and the at least one tangential accelerometer over an analysis period;

analyzing the acceleration information to determine a revolution rate of the drill bit; and estimating a gage pad wear responsive to an analysis of the revolution rate and the formation hardness information.

9. The drill bit of claim 8, wherein the data evaluation module is further configured for:

analyzing the acceleration information to determine at least one gage-slipping period, and at least one gage-cutting period; and wherein the estimating the gage pad wear further comprises including the at least one gage-slipping period, and the at least one gage-cutting period in the analysis of the revolution rate, and the formation hardness information.

10. The drill bit of claim 9, wherein the data evaluation module is further configured to:

determine the at least one gage-cutting period as a time period when the tangential acceleration is larger than the radial acceleration; and determine the at least one gage-slipping period as a time period when the radial acceleration is larger than the tangential acceleration.

11. The drill bit of claim 8, wherein the data evaluation module is further configured to report the gage pad wear through the communication port.

12. The drill bit of claim 8, wherein the data evaluation module is further configured for:

forming a gage-pad-wear history by repeating the estimating the gage pad wear over the analysis period; and reporting the gage-pad-wear history through the communication port.

13. The drill bit of claim 12, wherein the data evaluation module is further configured for:

extrapolating the gage-pad-wear history to determine a wear limit when the gage pad wear will approach a critical wear amount at a future time, a future depth, or a combination thereof; and reporting the wear limit through the communication port.

14. The drill bit of claim 8, further comprising an X magnetometer and a Y magnetometer operably coupled to the data evaluation module and wherein the data evaluation module is further configured for:

sampling magnetometer information from the X magnetometer and the Y magnetometer over the analysis period; and including the magnetometer information to determine the revolution rate.

15. A method, comprising:

periodically collecting sensor data by sampling over an analysis period at least one tangential accelerometer disposed in a drill bit and at least one radial accelerometer disposed in the drill bit;

processing the sensor data in the drill bit to develop a tangential acceleration history and a radial acceleration history;

analyzing the tangential acceleration history and the radial acceleration history to determine a revolution rate of the drill bit, at least one gage-slipping period, and at least one gage-cutting period; and estimating a change in a gage-pad-wear state responsive to an analysis of the revolution rate, the at least one gage-cutting period and the at least one gage-slipping period.

16. The method of claim 15, further comprising reporting the gage-pad-wear state through a communication port of a data evaluation module operably coupled to the at least one tangential accelerometer and the at least one radial accelerometer.

17. The method of claim 16, further comprising modifying a drilling parameter responsive to the reporting the gage-pad-wear state, wherein the drilling parameter is selected from the group consisting of torque, rotational velocity, and weight on bit.

18. The method of claim 16, wherein reporting the gage-pad-wear state is performed periodically to indicate a gage-pad-wear history of the drill bit.

19. The method of claim 15, wherein:

the at least one gage-cutting period is determined as a time period when the tangential acceleration is larger than the radial acceleration; and the at least one gage-slipping period is determined as a time period when the radial acceleration is larger than the tangential acceleration.

20. The method of claim 15, further comprising receiving formation hardness information and wherein the estimating the change in the gage-pad-wear state further comprises including the formation hardness information in the analysis of the revolution rate, the at least one gage-cutting period and the at least one gage-slipping period.

21. The method of claim 15, further comprising:

extrapolating the gage-pad-wear state to determine a wear limit when the gage pad wear will approach a critical wear amount at a future time, a future depth, or a combination thereof; and reporting the wear limit.

22. A method, comprising:

collecting acceleration information by periodically sampling at least two accelerometers disposed in a drill bit over an analysis period to develop an acceleration history;

processing the acceleration history in the drill bit to determine a distance profile of at least one gage pad on the drill bit;

determining a current formation hardness;

analyzing the distance profile of the at least one gage pad and the current formation hardness to estimate a gage-pad-wear history; and reporting the gage-pad-wear history.

23. The method of claim 22, further comprising modifying a drilling parameter responsive to the reporting the gage-pad-wear history, wherein the drilling parameter is selected from the group consisting of torque, rotational velocity, and weight on bit.

24. The method of claim 22, wherein the acceleration information includes a tangential acceleration history and a radial acceleration history and further comprising:

analyzing the tangential acceleration history and the radial acceleration history to determine at least one gage-slipping period, and at least one gage-cutting period; and wherein the analyzing the distance profile further comprises including the at least one gage-cutting period and the at least one gage-slipping period with the current formation hardness.

25. The method of claim 24, wherein:

the at least one gage-cutting period is determined as a time period when the tangential acceleration history is larger than the radial acceleration history; and the at least one gage-slipping period is determined as a time period when the radial acceleration history is larger than the tangential acceleration history.

26. The method of claim 22, further comprising:

extrapolating the gage-pad-wear history to determine a wear limit when the gage pad wear will approach a critical wear amount at a future time, a future depth, or a combination thereof; and reporting the wear limit.

* * * * *